US011842677B1

(12) United States Patent
Hsiao

(10) Patent No.: US 11,842,677 B1
(45) Date of Patent: Dec. 12, 2023

(54) PIXEL CIRCUIT OF DISPLAY PANEL

(71) Applicant: Novatek Microelectronics Corp., Hsinchu (TW)

(72) Inventor: Sheng-Wen Hsiao, Changhua County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 18/073,441

(22) Filed: Dec. 1, 2022

(51) Int. Cl.
*G09G 3/32* (2016.01)

(52) U.S. Cl.
CPC ..... *G09G 3/32* (2013.01); *G09G 2300/0426* (2013.01); *G09G 2300/0819* (2013.01); *G09G 2300/0852* (2013.01); *G09G 2310/061* (2013.01); *G09G 2310/08* (2013.01)

(58) Field of Classification Search
CPC ..... G09G 3/32; G09G 2300/0426; G09G 2300/0819; G09G 2300/0852; G09G 2310/061; G09G 2310/08
See application file for complete search history.

(56) References Cited

U.S. PATENT DOCUMENTS

| | | | | |
|---|---|---|---|---|
| 9,177,505 | B2 | 11/2015 | Lin et al. | |
| 2014/0267468 | A1 | 9/2014 | Lin et al. | |
| 2016/0365031 | A1 | 12/2016 | Wu et al. | |
| 2021/0012713 | A1 | 1/2021 | Dong | |
| 2021/0201827 | A1* | 7/2021 | Jang | G09G 3/3291 |
| 2021/0366362 | A1* | 11/2021 | Xuan | G09G 3/3233 |
| 2022/0229336 | A1 | 7/2022 | Kimura | |
| 2022/0375408 | A1 | 11/2022 | Dong | |

FOREIGN PATENT DOCUMENTS

| | | |
|---|---|---|
| CN | 114120886 | 3/2022 |
| TW | 201435837 | 9/2014 |
| TW | 202001865 | 1/2020 |

OTHER PUBLICATIONS

"Office Action of Taiwan Counterpart Application", dated Oct. 3, 2023, p1-p4.

* cited by examiner

*Primary Examiner* — Andrew Sasinowski
(74) *Attorney, Agent, or Firm* — JCIPRNET

(57) ABSTRACT

The disclosure provides a pixel circuit of a display panel. The pixel circuit includes a light-emitting element, a transistor, a first capacitor, a second capacitor, a first switch, and a second switch. The transistor is disposed in a driving current path to adjust the driving current of the light-emitting element. A first terminal of the first switch is coupled to a data line. A second terminal of the first switch is coupled to a first terminal of the first capacitor and a control terminal of the transistor. A first terminal of the second switch is coupled to a second terminal of the first capacitor and a first terminal of the second capacitor. A second terminal of the second switch is coupled to a first terminal of the transistor. A second terminal of the second capacitor is coupled to a reference voltage.

12 Claims, 10 Drawing Sheets

PIXEL CIRCUIT OF DISPLAY PANEL

BACKGROUND

Technical Field

The disclosure relates to a display panel, and in particular relates to a pixel circuit of a display panel.

Description of Related Art

Generally speaking, each pixel circuit of a self-luminous display panel has a light-emitting element. For example, the pixel circuit may be configured with organic light-emitting diodes (OLEDs) or other diodes. The driving current of the driving current path of the pixel circuit flows through the diode so that the diode emits light. By adjusting the driving current of the diode, the brightness of the diode (the gray scale of the pixel circuit) may be adjusted. However, diodes are susceptible to process variations that change their diode forward voltage. In previous pixel circuits, the driving current of the diode was affected by the diode forward voltage variation. Finding a way such that the driving current of the diode is not affected by the diode forward voltage variation is one of many technical issues in the art.

SUMMARY

The disclosure provides a pixel circuit of a display panel, which is not affected by the forward voltage variation of the light-emitting element.

In an embodiment of the disclosure, the pixel circuit includes a light-emitting element, a transistor, a first capacitor, a second capacitor, a first switch, and a second switch. A driving current of a driving current path of the pixel circuit flows through the light-emitting element so that the light-emitting element emits light. The transistor is disposed in the driving current path to adjust the driving current. A first terminal of the first capacitor is coupled to a control terminal of the transistor. A first terminal of the second capacitor is coupled to a second terminal of the first capacitor. A second terminal of the second capacitor is coupled to a reference voltage. A first terminal of the first switch is coupled to a data line of the display panel. A second terminal of the first switch is coupled to the first terminal of the first capacitor and the control terminal of the transistor. A first terminal of the second switch is coupled to a second terminal of the first capacitor and the first terminal of the second capacitor. A second terminal of the second switch is coupled to a first terminal of the transistor.

Based on the above, in an embodiment of the disclosure, the pixel circuit may use the first capacitor to sample the threshold voltage of the transistor to compensate the pixel data. During the emission period, the second switch is turned on, so that the first capacitor may maintain/clamp the voltage difference between the control terminal of the transistor and the first terminal of the transistor (e.g., the gate-source voltage, Vgs) to the compensated voltage. Based on the stable gate-source voltage, the driving current flowing through the transistor may be kept stable without being affected by the forward voltage variation of the light-emitting element.

In order to make the above-mentioned features and advantages of the disclosure comprehensible, embodiments accompanied with drawings are described in detail below.

DETAILED DESCRIPTION OF DISCLOSED EMBODIMENTS

Figure 1:
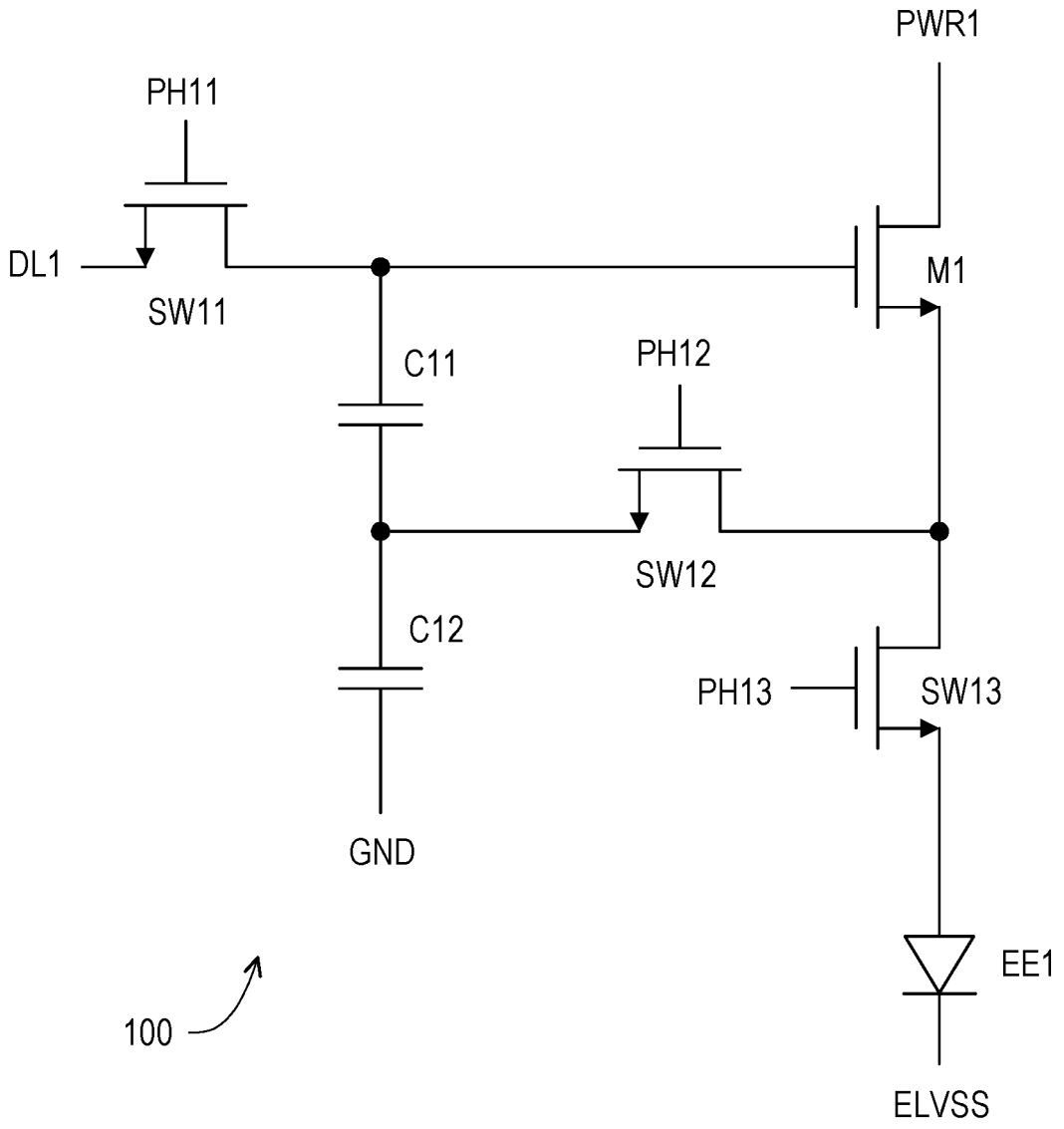
FIG. 1 is a circuit schematic diagram of a pixel circuit of a display panel according to a first embodiment of the disclosure.

The term "coupled (or connected)" as used throughout this specification (including the scope of the application) may refer to any direct or indirect means of connection. For example, if it is described in the specification that a first device is coupled (or connected) to a second device, it should be construed that the first device may be directly connected to the second device, or the first device may be indirectly connected to the second device through another device or some type of connecting means. Terms "first," "second" and the like mentioned in the full text (including the scope of the patent application) of the description of this application are used only to name the elements or to distinguish different embodiments or scopes and are not intended to limit the upper or lower limit of the number of the elements, nor is it intended to limit the order of the elements. In addition, wherever possible, elements/components/steps with the same reference numerals in the drawings and embodiments represent the same or similar parts. Elements/components/steps that use the same reference numerals or use the same terminology in different embodiments may refer to relevant descriptions of each other.

FIG. 1 is a circuit schematic diagram of a pixel circuit 100 of a display panel according to a first embodiment of the disclosure. The pixel circuit 100 is coupled to the data line DL1 of the display panel to receive the data voltage. The pixel circuit 100 is coupled to the first power voltage line PWR1 of the display panel to receive the power voltage. The pixel circuit 100 is further coupled to the second power voltage line of the display panel to receive another power voltage ELVSS. The pixel circuit 100 is coupled to a reference voltage line of the display panel to receive a reference voltage (e.g., a ground voltage GND or other reference voltages).

The pixel circuit 100 shown in FIG. 1 includes a light-emitting element EE1, a transistor M1, a capacitor C11, a capacitor C12, a switch SW11, a switch SW12, and a switch SW13. The switch SW11, the switch SW12, the switch SW13, and the transistor M1 are N-type metal oxide semiconductor (NMOS) transistors. In the pixel circuit 100 shown in FIG. 1, a driving current path of the pixel circuit 100 is formed between the first power voltage line PWR1 and the second power voltage line transmitting the power voltage ELVSS. The driving current of this driving current path flows from the first power voltage line PWR1 through the transistor M1, the switch SW13, and the light-emitting element EE1 so that the light-emitting element EE1 emits light. The transistor M1 is disposed in this driving current path to adjust the driving current of the light-emitting element EE1.

The first terminal of the capacitor C11 is coupled to the control terminal (e.g., the gate) of the transistor M1. The first terminal of the capacitor C12 is coupled to the second terminal of the capacitor C11. The second terminal of the capacitor C12 is coupled to the reference voltage line to receive a reference voltage (e.g., the ground voltage GND or other reference voltages). The first terminal of the switch SW11 is coupled to the data line DL1. The second terminal of the switch SW11 is coupled to the first terminal of the capacitor C11 and the control terminal of the transistor M1. The control terminal (e.g., the gate) of the switch SW11 is controlled by the control signal PH11. The control terminal (e.g., the gate) of the switch SW12 is controlled by the control signal PH12. The first terminal of the switch SW12 is coupled to the second terminal of the capacitor C11 and the first terminal of the capacitor C12. The second terminal of the switch SW12 is coupled to the first terminal (e.g., the source) of the transistor M1. The second terminal (e.g., the drain) of the transistor M1 is coupled to the first power voltage line PWR1. The control terminal (e.g., the gate) of the switch SW13 is controlled by the control signal PH13. The first terminal of the switch SW13 is coupled to the first terminal of the transistor M1 and the second terminal of the switch SW12. The second terminal of the switch SW13 is coupled to the first terminal of the light-emitting element EEL The second terminal of the light-emitting element EE1 is coupled to the second power voltage line to receive the power voltage ELVSS. Based on the actual design, the light-emitting element EE1 may include a micro light-emitting diode (μLED), an organic light-emitting diode (OLED), or other light-emitting elements. In the case where the light-emitting element EE1 is a light-emitting diode, the first terminal of the light-emitting element EE1 is the anode, and the second terminal of the light-emitting element EE1 is the cathode.

During the compensation period, the capacitor C11 may sample the threshold voltage of the transistor M1 to compensate the pixel data. During the data writing period, the first terminal of the capacitor C11 may store the data voltage from the data line DL1. During the emission period, the switch SW12 is turned on, so that the capacitor C11 may maintain/clamp the voltage difference between the control terminal of the transistor M1 and the first terminal of the transistor M1 (e.g., the gate-source voltage, Vgs) to the compensated voltage. Based on the stable gate-source voltage Vgs, the driving current flowing through the transistor M1 may be kept stable without being affected by the forward voltage variation of the light-emitting element EEL The detailed operation of the pixel circuit 100 is described below with the example shown in FIG. 2.

Figure 2:
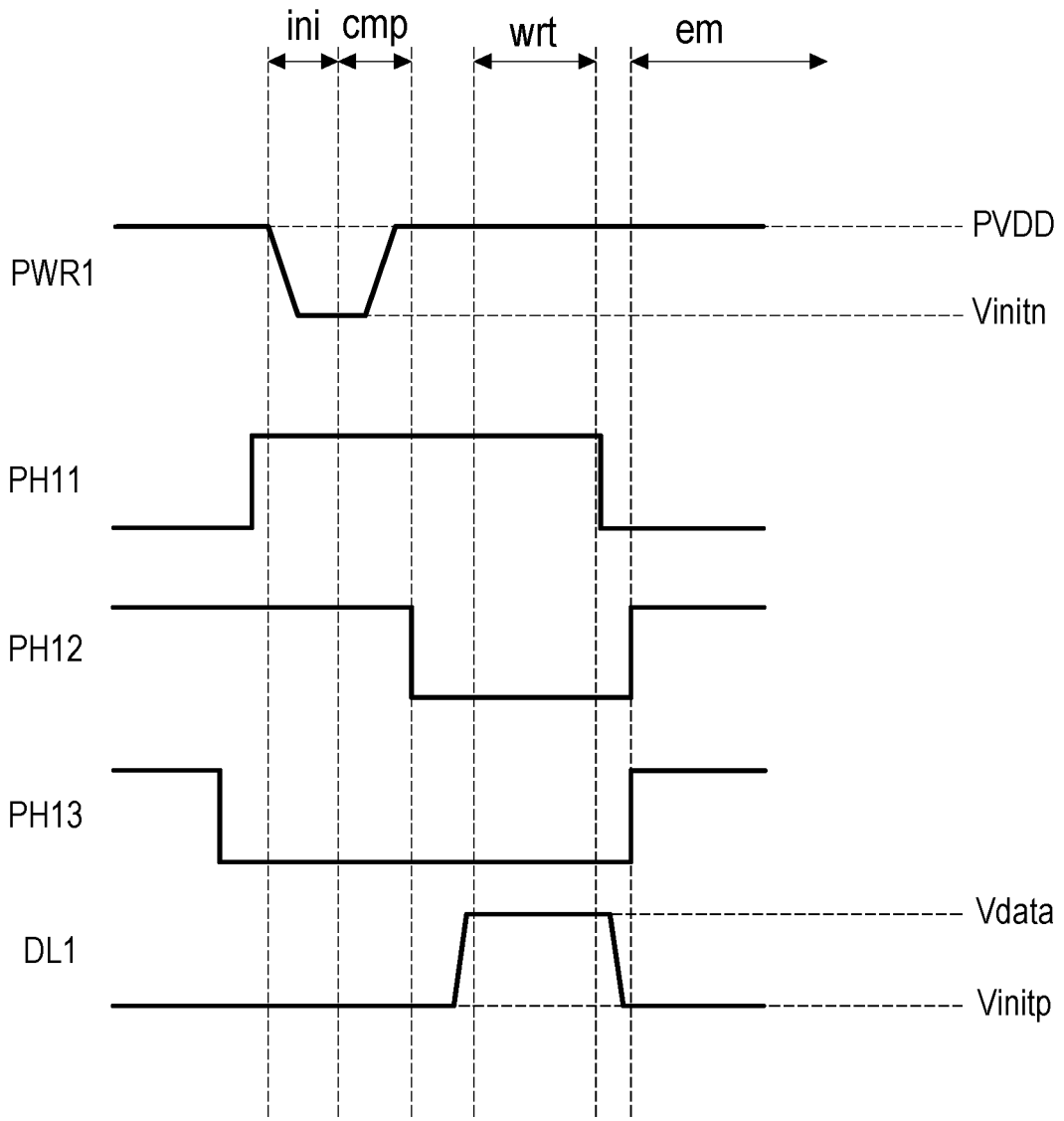
FIG. 2 is a time sequence schematic diagram of a control signal of a pixel circuit according to an embodiment of the disclosure.

FIG. 2 is a time sequence schematic diagram of a control signal of a pixel circuit according to an embodiment of the disclosure. Referring to FIG. 1 and FIG. 2, during the initialization period ini, the voltage of the first power voltage line PWR1 transitions from the power voltage PVDD to the initialization voltage Vinitn. The levels of the power voltage PVDD and the initialization voltage Vinitn may be determined according to the actual design. For example, the power voltage PVDD may be greater than the initialization voltage Vinitn. During the initialization period ini, the switch SW11 and the switch SW12 are turned on, and the switch SW13 is turned off. Therefore, the initialization voltage Vinitp of the data line DL1 may be transmitted to the gate of the transistor M1 through the switch SW11. The level of the initialization voltage Vinitp may be determined according to the actual design. For example, it is assumed that the threshold voltage of the transistor M1 is Vt, and the initialization voltage Vinitp is greater than Vinitn+Vt. Therefore, the initialization voltage Vinitp of the data line DL1 may turn on the transistor M1 through the switch SW11, and the initialization voltage Vinitn of the first power voltage line PWR1 may reset the second terminal of the capacitor C11 through the transistor M1 and the switch SW12. When the initialization period ini ends, the first terminal voltage and the second terminal voltage of the reset capacitor C11 are respectively the initialization voltages Vinitp and Vinitn.

During the compensation period cmp, the switch SW11 and the switch SW12 are turned on, the switch SW13 is turned off, and the voltage of the first power voltage line PWR1 transitions from the initialization voltage Vinitn to the power voltage PVDD. During the voltage transition process of the first power voltage line PWR1, the first terminal voltage (e.g., the source voltage) of the transistor M1 is also pulled up accordingly. When the gate-source voltage Vgs of the transistor M1 reaches the threshold voltage Vt (at this time, the source voltage of the transistor M1 is Vinitp−Vt), the transistor M1 is turned off, and the voltage difference between the two terminals of the capacitor C11 is the threshold voltage Vt. Therefore, the capacitor C11 may sample the threshold voltage Vt of the transistor M1 when the compensation period cmp ends.

During the data writing period wrt, the switch SW11 is turned on, and the switch SW12 and the switch SW13 are turned off. At this time, the capacitor C11 maintains the threshold voltage Vt of the transistor M1, and the voltage of the data line DL1 transitions from the initialization voltage Vinitp to the data voltage Vdata. The first terminal of the capacitor C11 may store the data voltage Vdata from the data line DL1. Since the first terminal voltage of the capacitor C11 is pulled up from the initialization voltage Vinitp to the data voltage Vdata, the voltage difference between the two terminals of the capacitor C11 is pulled up from the threshold voltage Vt to Vt+ΔV, where $\Delta V=(Vdata-Vinitp)*\alpha$, and $\alpha=C12/(C11+C12)$. That is, based on the threshold voltage Vt, the pixel data stored in the capacitor C11 has been compensated.

During the emission period em, the switch SW11 is turned off, and the switch SW12 and the switch SW13 are turned on. At this time, the data voltage Vdata stored at the first terminal of the capacitor C11 may drive the control terminal of the transistor M1, thereby determining the driving current flowing through the transistor M1. The driving current adjusted by the transistor M1 may flow through the light-emitting element EE1 so that the light-emitting element EE1 emits light. By adjusting the driving current of the light-emitting element EE1, the brightness of the light-emitting element EE1 (the gray scale of the pixel circuit 100) may be adjusted. Based on the threshold voltage Vt sampled from the capacitor C11, the gate-source voltage Vgs of the transistor M1 has been compensated.

Generally speaking, the forward voltage of the light-emitting element EE1 is susceptible to process variations that change its diode forward voltage. During the emission period em, the switch SW12 is turned on, so that the capacitor C11 may maintain/clamp the voltage difference between the control terminal of the transistor M1 and the first terminal of the transistor M1 (e.g., the gate-source voltage Vgs) to the compensated voltage Vt+ΔV. Based on the stable gate-source voltage Vgs, the driving current flowing through the transistor M1 may be kept stable without being affected by the forward voltage variation of the light-emitting element EE1.

Figure 3:
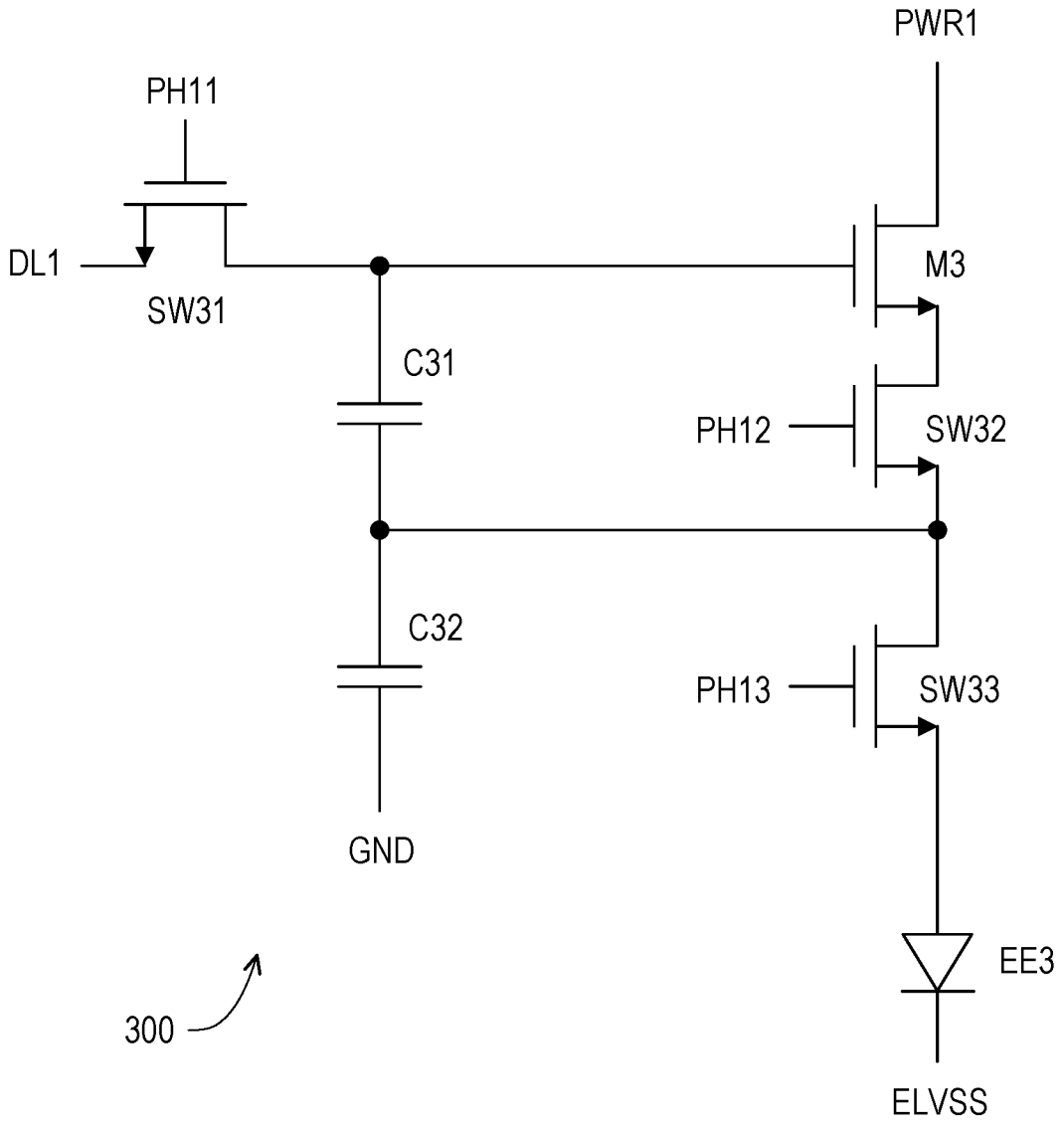
FIG. 3 is a circuit schematic diagram of a pixel circuit of a display panel according to a second embodiment of the disclosure.

FIG. 3 is a circuit schematic diagram of a pixel circuit 300 of a display panel according to a second embodiment of the disclosure. The pixel circuit 300 shown in FIG. 3 includes a light-emitting element EE3, a transistor M3, a capacitor C31, a capacitor C32, a switch SW31, a switch SW32, and a switch SW33. The pixel circuit 300, the light-emitting element EE3, the transistor M3, the capacitor C31, the capacitor C32, the switch SW31, the switch SW32, and the switch SW33 shown in FIG. 3 may refer by analogy to the pixel circuit 100, the light-emitting element EE1, the transistor M1, the capacitor C11, the capacitor C12, the switch SW11, the switch SW12, and the switch SW13 shown in FIG. 1, and are not repeated herein.

In the embodiment shown in FIG. 3, the first terminal (e.g., the drain) of the switch SW33 is coupled to the first terminal (e.g., the source) of the switch SW32, the second terminal of the capacitor C31 and the first terminal of the capacitor C32, the second terminal (e.g., the source) of the switch SW33 is coupled to the first terminal (e.g., the anode) of the light-emitting element EE3, and the second terminal (e.g., the cathode) of the light-emitting element EE3 is coupled to the second power voltage line to receive the power voltage ELVSS. In the pixel circuit 300 shown in FIG. 3, a driving current path of the pixel circuit 300 is formed between the first power voltage line PWR1 and the second power voltage line transmitting the power voltage ELVSS. The driving current of this driving current path flows from the first power voltage line PWR1 through the transistor M3, the switch SW32, the switch SW33, and the light-emitting element EE3 so that the light-emitting element EE3 emits light. The transistor M3 is disposed in this driving current path to adjust the driving current of the light-emitting element EE3.

The first power voltage line PWR1, the data line DL1, the switch SW31, the switch SW32, and the switch SW33 shown in FIG. 3 may also refer to the time sequence description of the first power voltage line PWR1, the data line DL1, the control signal PH11, the control signal PH12, and the control signal PH13 shown in FIG. 2. During the compensation period cmp, the capacitor C31 may sample the threshold voltage Vt of the transistor M3 to compensate the pixel data. During the data writing period wrt, the first terminal of the capacitor C31 may store the data voltage from the data line DL1. During the emission period em, the switch SW32 is turned on, so that the capacitor C31 may maintain/clamp the voltage difference between the control terminal of the transistor M3 and the first terminal of the transistor M3 (e.g., the gate-source voltage Vgs) to the compensated voltage Vt+ΔV. Based on the stable gate-source voltage Vgs, the driving current flowing through the transistor M3 may be kept stable without being affected by the forward voltage variation of the light-emitting element EE3.

Figure 4:
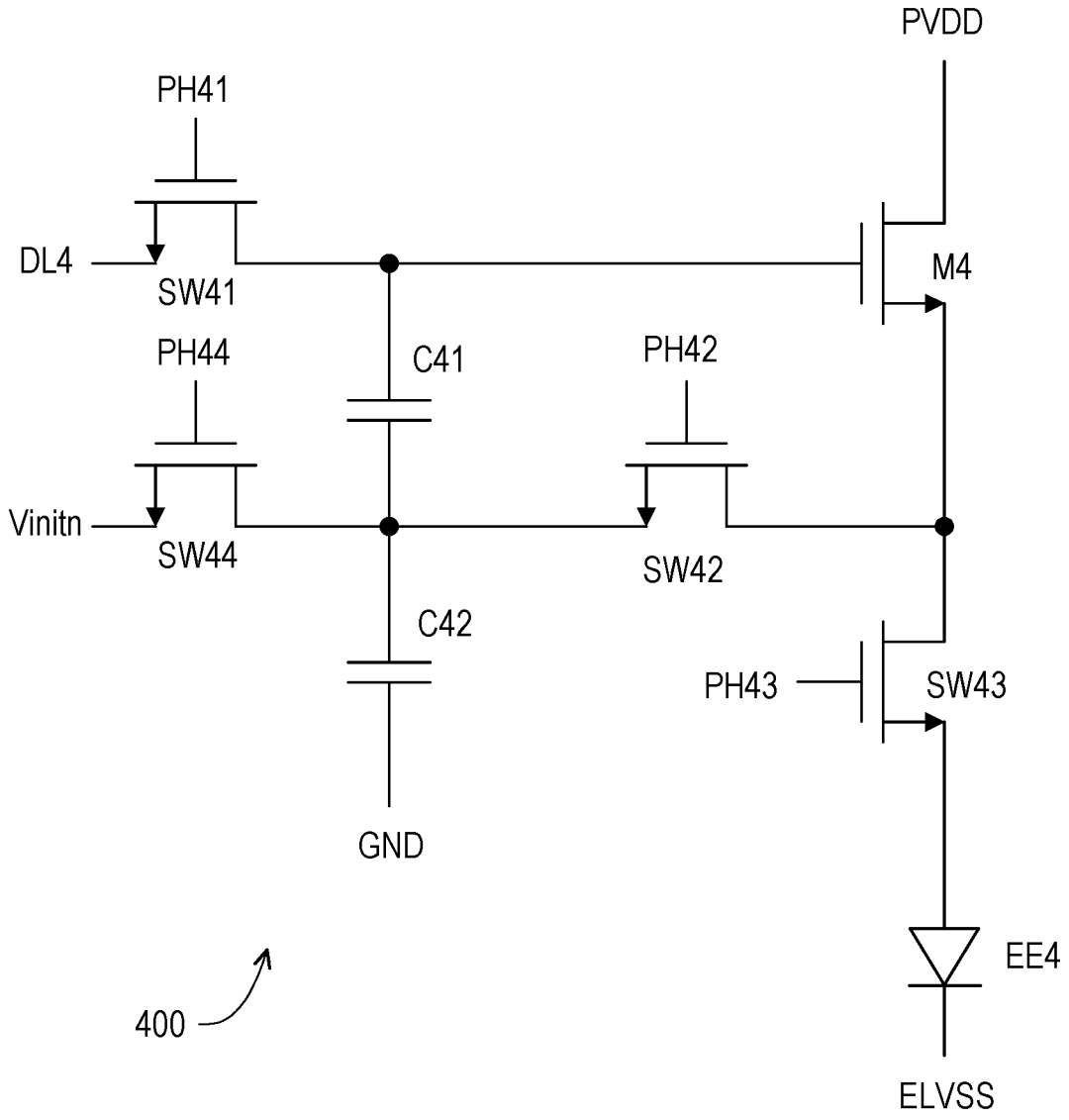
FIG. 4 is a circuit schematic diagram of a pixel circuit of a display panel according to a third embodiment of the disclosure.

FIG. 4 is a circuit schematic diagram of a pixel circuit 400 of a display panel according to a third embodiment of the disclosure. The pixel circuit 400 is coupled to the data line DL4 of the display panel to receive the data voltage. The pixel circuit 400 is coupled to the first power voltage line of the display panel to receive the power voltage PVDD. The pixel circuit 400 is further coupled to the second power voltage line of the display panel to receive another power voltage ELVSS. The pixel circuit 400 is coupled to the initialization voltage line of the display panel to receive the initialization voltage Vinitn. The pixel circuit 400 is coupled to a reference voltage line of the display panel to receive a reference voltage (e.g., a ground voltage GND or other reference voltages).

The pixel circuit 400 shown in FIG. 4 includes a light-emitting element EE4, a transistor M4, a capacitor C41, a capacitor C42, a switch SW41, a switch SW42, a switch SW43, and a switch SW44. The switch SW41, the switch SW42, the switch SW43, the switch SW44, and the transistor M4 are NMOS transistors. In the pixel circuit 400 shown in FIG. 4, a driving current path of the pixel circuit 400 is formed between the first power voltage line transmitting the power voltage PVDD and the second power voltage line transmitting the power voltage ELVSS. The driving current of this driving current path flows from the first power voltage line through the transistor M4, the switch SW43, and the light-emitting element EE4 so that the light-emitting element EE4 emits light. The transistor M4 is disposed in this driving current path to adjust the driving current of the light-emitting element EE4. Based on the actual design, the light-emitting element EE4 may include μLED, OLED, or other light-emitting elements. In the case where the light-emitting element EE4 is a light-emitting diode, the first terminal of the light-emitting element EE4 is the anode, and the second terminal of the light-emitting element EE4 is the cathode.

The coupling relationship between the light-emitting element EE4, the transistor M4, the capacitor C41, the capacitor C42, the switch SW41, the switch SW42, and the switch SW43 shown in FIG. 4 may refer to the light-emitting element EE1, the transistor M1, the capacitor C11, the capacitor C12, the switch SW11, the switch SW12, and the switch SW13 shown in FIG. 1, and are not repeated herein. The control terminal (e.g., the gate) of the switch SW41 is controlled by the control signal PH41, the control terminal (e.g., the gate) of the switch SW42 is controlled by the control signal PH42, and the control terminal (e.g., the gate) of the switch SW43 is controlled by the control signal PH43. In the embodiment shown in FIG. 4, the drain voltage of the transistor M4 may be a fixed power voltage PVDD. The first terminal (e.g., the source) of the switch SW44 is coupled to the initialization voltage line to receive the initialization voltage Vinitn. The second terminal (e.g., the drain) of the switch SW44 is coupled to the second terminal of the capacitor C41 and the first terminal of the capacitor C42. The control terminal (e.g., the gate) of the switch SW44 is controlled by the control signal PH44.

During the compensation period, the capacitor C41 may sample the threshold voltage Vt of the transistor M4 to compensate the pixel data. During the data writing period, the first terminal of the capacitor C41 may store the data voltage from the data line DL4. During the emission period, the switch SW42 is turned on, so that the capacitor C41 may maintain/clamp the voltage difference between the control terminal of the transistor M4 and the first terminal of the transistor M4 (e.g., the gate-source voltage Vgs) to the compensated voltage. Based on the stable gate-source voltage Vgs, the driving current flowing through the transistor M4 may be kept stable without being affected by the forward voltage variation of the light-emitting element EE4. The detailed operation of the pixel circuit 400 is described below with the example shown in FIG. 5.

Figure 5:
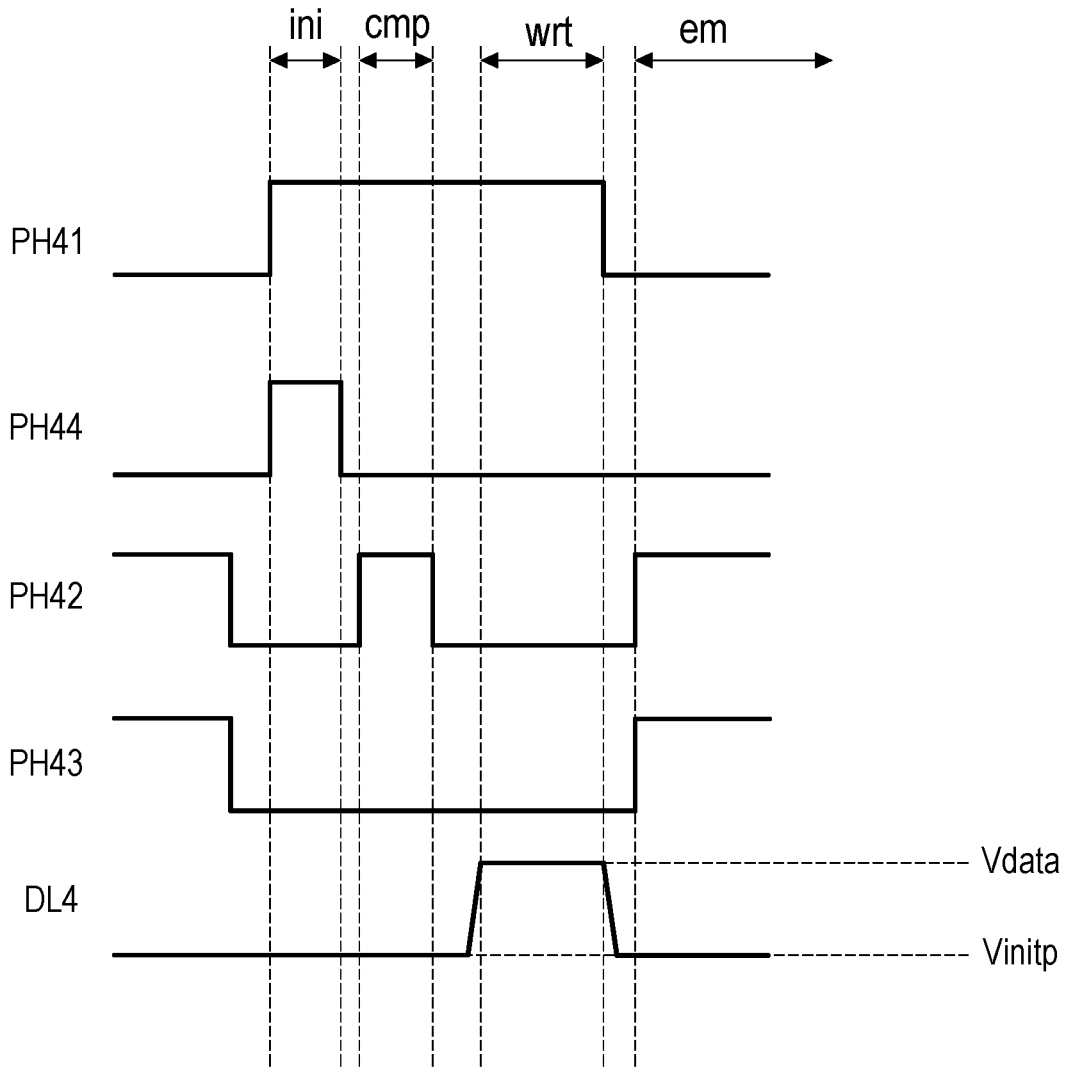
FIG. 5 is a time sequence schematic diagram of a control signal of a pixel circuit according to another embodiment of the disclosure.

FIG. 5 is a time sequence schematic diagram of a control signal of a pixel circuit according to another embodiment of the disclosure. Referring to FIG. 4 and FIG. 5, during the initialization period ini, the switch SW41 and the switch SW44 are turned on, and the switch SW42 and the switch SW43 are turned off. Therefore, the initialization voltage Vinitp of the data line DL4 may reset the first terminal of the capacitor C41 and the gate of the transistor M4 through the switch SW41, and the initialization voltage Vinitn of the initialization voltage line may reset the second terminal of the capacitor C41 through the switch SW44.

During the compensation period cmp, the switch SW41 and the switch SW42 are turned on, and the switch SW43 and the switch SW44 are turned off. After the switch SW42 is turned on, the first terminal voltage (e.g., the source) of the transistor M4 transitions from the initialization voltage Vinitn to the direction of the power voltage PVDD of the first power voltage line. During the pull up process of the source voltage of the transistor M4, the gate-source voltage Vgs of the transistor M4 also decreases accordingly. When the gate-source voltage Vgs of the transistor M4 reaches the threshold voltage Vt (at this time, the source voltage of the transistor M4 is Vinitp−Vt), the transistor M4 is turned off, and the voltage difference between the two terminals of the capacitor C41 is the threshold voltage Vt. Therefore, the capacitor C41 may sample the threshold voltage Vt of the transistor M4 when the compensation period cmp ends.

During the data writing period wrt, the switch SW41 is turned on, and the switch SW42, the switch SW43 and the switch SW44 are turned off. At this time, the capacitor C41 maintains the threshold voltage Vt of the transistor M4, and the voltage of the data line DL4 transitions from the initialization voltage Vinitp to the data voltage Vdata. The first terminal of the capacitor C41 may store the data voltage Vdata from the data line DL4. Since the first terminal voltage of the capacitor C41 is pulled up from the initialization voltage Vinitp to the data voltage Vdata, the voltage difference between the two terminals of the capacitor C41 is pulled up from the threshold voltage Vt to Vt+ΔV, where ΔV=(Vdata−Vinitp)*α, and α=C42/(C41+C42). That is, based on the threshold voltage Vt, the pixel data stored in the capacitor C41 has been compensated.

During the emission period em, the switch SW41 and the switch SW44 are turned off, and the switch SW42 and the switch SW43 are turned on. At this time, the data voltage Vdata stored at the first terminal of the capacitor C41 may drive the control terminal of the transistor M4, thereby determining the driving current flowing through the transistor M4. The driving current adjusted by the transistor M4 may flow through the light-emitting element EE4 so that the light-emitting element EE4 emits light. By adjusting the driving current of the light-emitting element EE4, the brightness of the light-emitting element EE4 (the gray scale of the pixel circuit 400) may be adjusted. Based on the threshold voltage Vt sampled from the capacitor C41, the gate-source voltage Vgs of the transistor M4 has been compensated.

The forward voltage of the light-emitting element EE4 is susceptible to process variations that change its diode forward voltage. During the emission period em, the switch SW42 is turned on, so that the capacitor C41 may maintain/clamp the voltage difference between the control terminal of the transistor M4 and the first terminal of the transistor M4 (e.g., the gate-source voltage Vgs) to the compensated voltage Vt+ΔV. Based on the stable gate-source voltage Vgs, the driving current flowing through the transistor M4 may be kept stable without being affected by the forward voltage variation of the light-emitting element EE4.

Figure 6:
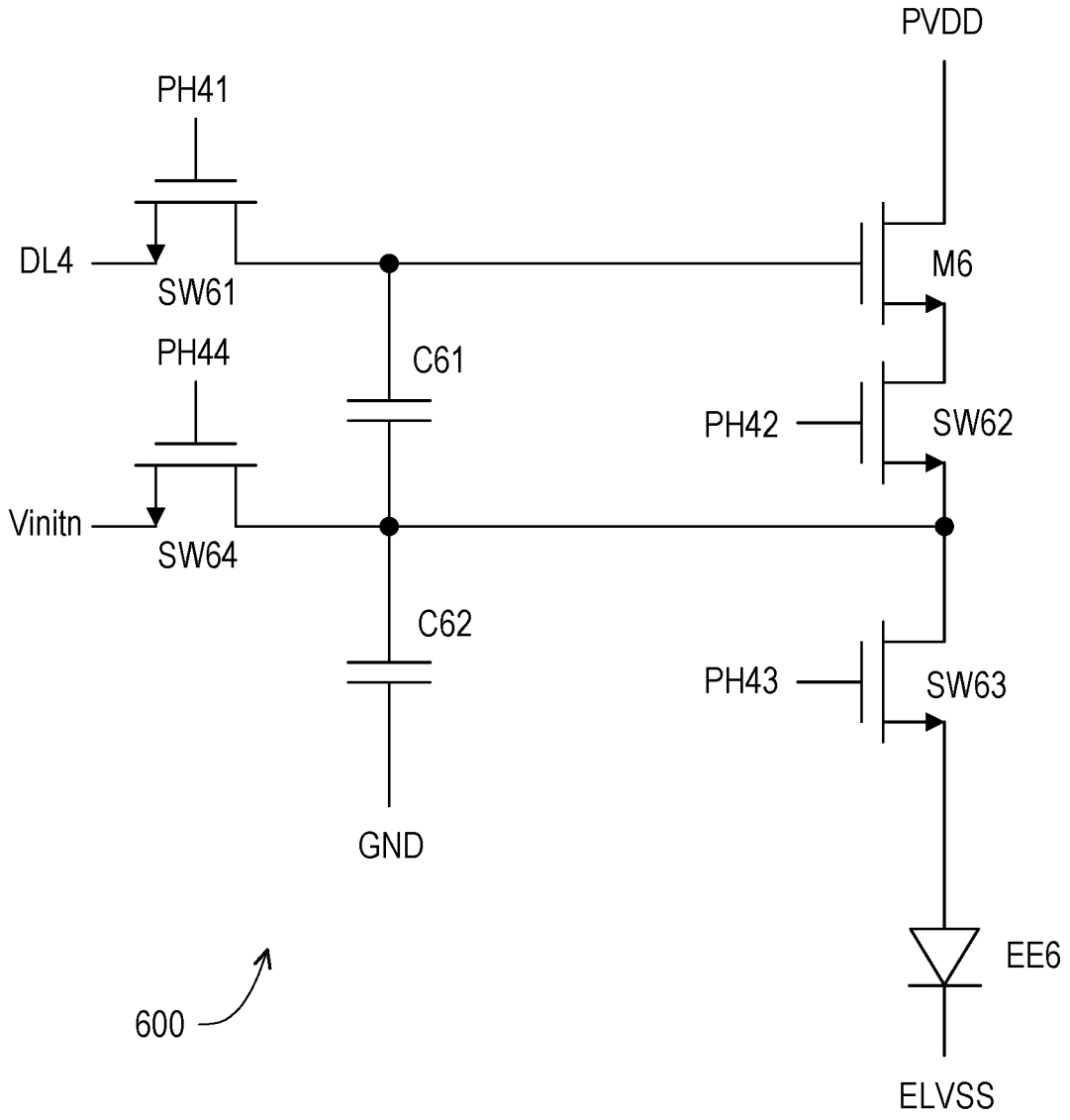
FIG. 6 is a circuit schematic diagram of a pixel circuit of a display panel according to a fourth embodiment of the disclosure.

FIG. 6 is a circuit schematic diagram of a pixel circuit 600 of a display panel according to a fourth embodiment of the disclosure. The pixel circuit 600 shown in FIG. 6 includes a light-emitting element EE6, a transistor M6, a capacitor C61, a capacitor C62, a switch SW61, a switch SW62, a switch SW63, and a switch SW64. The pixel circuit 600, the light-emitting element EE6, the transistor M6, the capacitor C61, the capacitor C62, the switch SW61, the switch SW62, the switch SW63, and the switch SW64 shown in FIG. 6 may refer by analogy to the pixel circuit 400, the light-emitting element EE4, the transistor M4, the capacitor C41, the capacitor C42, the switch SW41, the switch SW42, the switch SW43, and the switch SW44 shown in FIG. 4, and are not repeated herein.

In the embodiment shown in FIG. 6, the first terminal (e.g., the drain) of the switch SW63 is coupled to the first terminal (e.g., the source) of the switch SW62, the second terminal of the capacitor C61 and the first terminal of the capacitor C62, the second terminal (e.g., the source) of the switch SW63 is coupled to the first terminal (e.g., the anode) of the light-emitting element EE6, and the second terminal (e.g., the cathode) of the light-emitting element EE6 is coupled to the second power voltage line to receive the power voltage ELVSS. In the pixel circuit 600 shown in FIG. 6, a driving current path of the pixel circuit 600 is formed between the first power voltage line transmitting the power voltage PVDD and the second power voltage line transmitting the power voltage ELVSS. The driving current of this driving current path flows from the first power voltage line through the transistor M6, the switch SW62, the switch SW63, and the light-emitting element EE6 so that the light-emitting element EE6 emits light. The transistor M6 is disposed in this driving current path to adjust the driving current of the light-emitting element EE6.

The data line DL4, the switch SW61, the switch SW62, the switch SW63, and the switch SW64 shown in FIG. 6 may also refer to the time sequence description of the data line DL4, the control signal PH41, the control signal PH42, and the control signal PH43 shown in FIG. 5. During the compensation period cmp, the capacitor C61 may sample the threshold voltage Vt of the transistor M6 to compensate the pixel data. During the data writing period wrt, the first terminal of the capacitor C61 may store the data voltage from the data line DL4. During the emission period em, the switch SW62 is turned on, so that the capacitor C61 may maintain/clamp the voltage difference between the control terminal of the transistor M6 and the first terminal of the transistor M6 (e.g., the gate-source voltage Vgs) to the compensated voltage Vt+ΔV. Based on the stable gate-source voltage Vgs, the driving current flowing through the transistor M6 may be kept stable without being affected by the forward voltage variation of the light-emitting element EE6.

Figure 7:
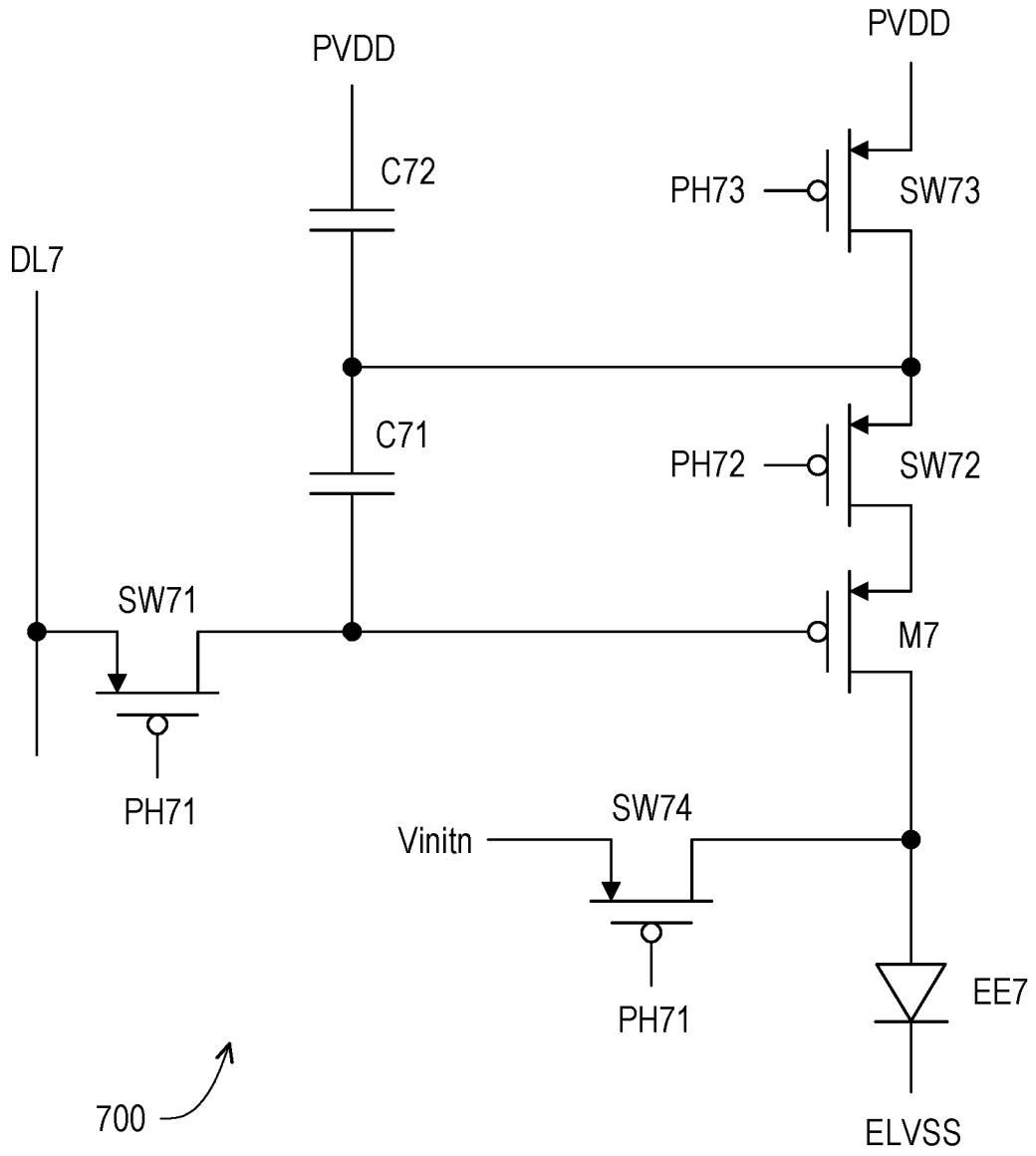
FIG. 7 is a circuit schematic diagram of a pixel circuit of a display panel according to a fifth embodiment of the disclosure.

FIG. 7 is a circuit schematic diagram of a pixel circuit 700 of a display panel according to a fifth embodiment of the disclosure. The pixel circuit 700 is coupled to the data line DL7 of the display panel to receive the data voltage. The pixel circuit 700 is coupled to the first power voltage line of the display panel to receive the power voltage PVDD. The pixel circuit 700 is further coupled to the second power voltage line of the display panel to receive another power voltage ELVSS. The pixel circuit 700 is coupled to the initialization voltage line of the display panel to receive the initialization voltage Vinitn.

The pixel circuit 700 shown in FIG. 7 includes a light-emitting element EE7, a transistor M7, a capacitor C71, a capacitor C72, a switch SW71, a switch SW72, a switch SW73, and a switch SW74. The switch SW71, the switch SW72, the switch SW73, the switch SW74, and the transistor M7 are P-type metal oxide semiconductor (PMOS) transistors. In the pixel circuit 700 shown in FIG. 7, a driving current path of the pixel circuit 700 is formed between the first power voltage line transmitting the power voltage PVDD and the second power voltage line transmitting the power voltage ELVSS. The driving current of this driving current path flows from the first power voltage line through the switch SW73, the switch SW72, the transistor M7, and the light-emitting element EE7 so that the light-emitting element EE7 emits light. The transistor M7 is disposed in this driving current path to adjust the driving current of the light-emitting element EE7. Based on the actual design, the light-emitting element EE7 may include μLED, OLED, or other light-emitting elements. In the case where the light-emitting element EE7 is a light-emitting diode, the first terminal of the light-emitting element EE7 is the anode, and the second terminal of the light-emitting element EE7 is the cathode.

The first terminal of the capacitor C71 is coupled to the control terminal (e.g., the gate) of the transistor M7. The first terminal of the capacitor C72 is coupled to the second terminal of the capacitor C71. The second terminal of the capacitor C72 is coupled to the reference voltage line to receive a reference voltage (e.g., the power voltage PVDD or other reference voltages). The first terminal of the switch SW71 is coupled to the data line DL7. The second terminal of the switch SW71 is coupled to the first terminal of the capacitor C71 and the control terminal of the transistor M7. The control terminal (e.g., the gate) of the switch SW71 is controlled by the control signal PH71, and the control terminal (e.g., the gate) of the switch SW72 is controlled by the control signal PH72. The first terminal of the switch SW72 is coupled to the second terminal of the capacitor C71 and the first terminal of the capacitor C72. The second terminal of the switch SW72 is coupled to the first terminal (e.g., the source) of the transistor M7. The first terminal of the switch SW73 is coupled to the first terminal of the switch SW72. The second terminal of the switch SW73 is coupled to the first power voltage line of the display panel to receive the power voltage PVDD. The control terminal (e.g., the gate) of the switch SW73 is controlled by the control signal PH73. The second terminal (e.g., the drain) of the transistor M7 is coupled to the first terminal (e.g., the anode) of the light-emitting element EE7. The second terminal (e.g., the cathode) of the light-emitting element EE7 is coupled to the second power voltage line of the display panel to receive the power voltage ELVSS. The first terminal of the switch SW74 is coupled to the initialization voltage line of the display panel to receive the initialization voltage Vinitn. The second terminal of the switch SW74 is coupled to the second terminal of the transistor M7 and the first terminal of the light-emitting element EE7. The control terminal (e.g., the gate) of the switch SW74 is controlled by the control signal PH71.

During the compensation period, the capacitor C71 may sample the threshold voltage Vt of the transistor M7 to compensate the pixel data. During the data writing period, the first terminal of the capacitor C71 may store the data voltage from the data line DL7. During the emission period, the switch SW72 is turned on, so that the capacitor C71 may maintain/clamp the voltage difference between the control terminal of the transistor M7 and the first terminal of the transistor M7 (e.g., the gate-source voltage Vgs) to the compensated voltage. Based on the stable gate-source voltage Vgs, the driving current flowing through the transistor M7 may be kept stable without being affected by the forward voltage variation of the light-emitting element EE7. The detailed operation of the pixel circuit 700 is described below with the example shown in FIG. 8.

Figure 8:
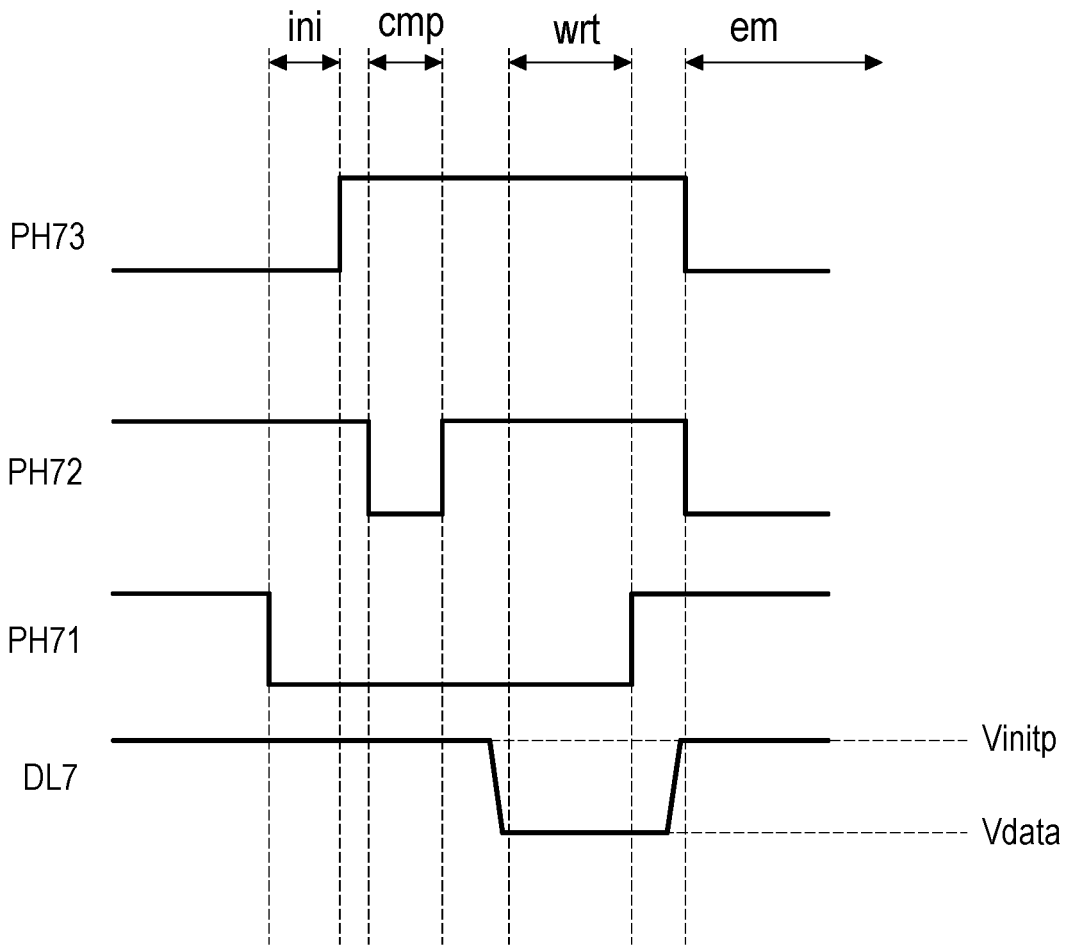
FIG. 8 is a time sequence schematic diagram of a control signal of a pixel circuit according to yet another embodiment of the disclosure.

FIG. 8 is a time sequence schematic diagram of a control signal of a pixel circuit according to yet another embodiment of the disclosure. Referring to FIG. 7 and FIG. 8, during the initialization period ini, the switch SW71, the switch SW73, and the switch SW74 are turned on, and the switch SW72 is turned off. Therefore, the initialization voltage Vinitp of the data line DL7 may turn off the transistor M7 through the switch SW71, the initialization voltage Vinitn of the initialization voltage line may initialize the first terminal of the light-emitting element EE7 through the switch SW74, and the power voltage PVDD of the first power voltage line may reset the second terminal of the capacitor C71 through the switch SW73.

During the compensation period cmp, the switch SW71, the switch SW72, and the switch SW74 are turned on, and the switch SW73 is turned off. After the switch SW72 is turned on, the power voltage PVDD of the second terminal voltage of the capacitor C71 is transmitted to the first terminal voltage of the transistor M7, and the transistor M7 is turned on. The first terminal voltage of the transistor M7 (the second terminal voltage of the capacitor C71) transitions from the power voltage PVDD to the direction of the initialization voltage Vinitn. During the decreasing process of the source voltage of the transistor M7, the gate-source voltage Vgs of the transistor M7 also decreases accordingly. When the gate-source voltage Vgs of the transistor M7 reaches the threshold voltage Vt (at this time, the source voltage of the transistor M7 is Vinitp+Vt), the transistor M7 is turned off, and the voltage difference between the two terminals of the capacitor C71 is the threshold voltage Vt. Therefore, the capacitor C71 may sample the threshold voltage Vt of the transistor M7 when the compensation period cmp ends.

During the data writing period wrt, the switch SW71 and the switch SW74 are turned on, and the switch SW72 and the switch SW73 are turned off. At this time, the capacitor C71 may maintain the threshold voltage Vt of the transistor M7, and the voltage of the data line DL7 transitions from the initialization voltage Vinitp to the data voltage Vdata. The first terminal of the capacitor C71 may store the data voltage Vdata from the data line DL7. Since the first terminal voltage of the capacitor C71 is decreased from the initialization voltage Vinip to the data voltage Vdata, the voltage difference between the two terminals of the capacitor C71 is changed from the threshold voltage Vt to Vt+ΔV, where $\Delta V=(Vdata-Vinitp)*\alpha$, and $\alpha=C72/(C71+C72)$. That is, based on the threshold voltage Vt, the pixel data stored in the capacitor C71 has been compensated.

During the emission period em, the switch SW71 and the switch SW74 are turned off, and the switch SW72 and the switch SW73 are turned on. At this time, the data voltage Vdata stored at the first terminal of the capacitor C71 may drive the control terminal of the transistor M7, thereby determining the driving current flowing through the transistor M7. The driving current adjusted by the transistor M7 may flow through the light-emitting element EE7 so that the light-emitting element EE7 emits light. By adjusting the driving current of the light-emitting element EE7, the brightness of the light-emitting element EE7 (the gray scale of the pixel circuit 700) may be adjusted. Based on the threshold voltage Vt sampled from the capacitor C71, the gate-source voltage Vgs of the transistor M7 has been compensated.

The forward voltage of the light-emitting element EE7 is susceptible to process variations that change its diode forward voltage. During the emission period em, the switch SW72 is turned on, so that the capacitor C71 may maintain/clamp the voltage difference between the control terminal of the transistor M7 and the first terminal of the transistor M7 (e.g., the gate-source voltage Vgs) to the compensated voltage Vt+ΔV. Based on the stable gate-source voltage Vgs, the driving current flowing through the transistor M7 may be kept stable without being affected by the forward voltage variation of the light-emitting element EE7.

Figure 9:
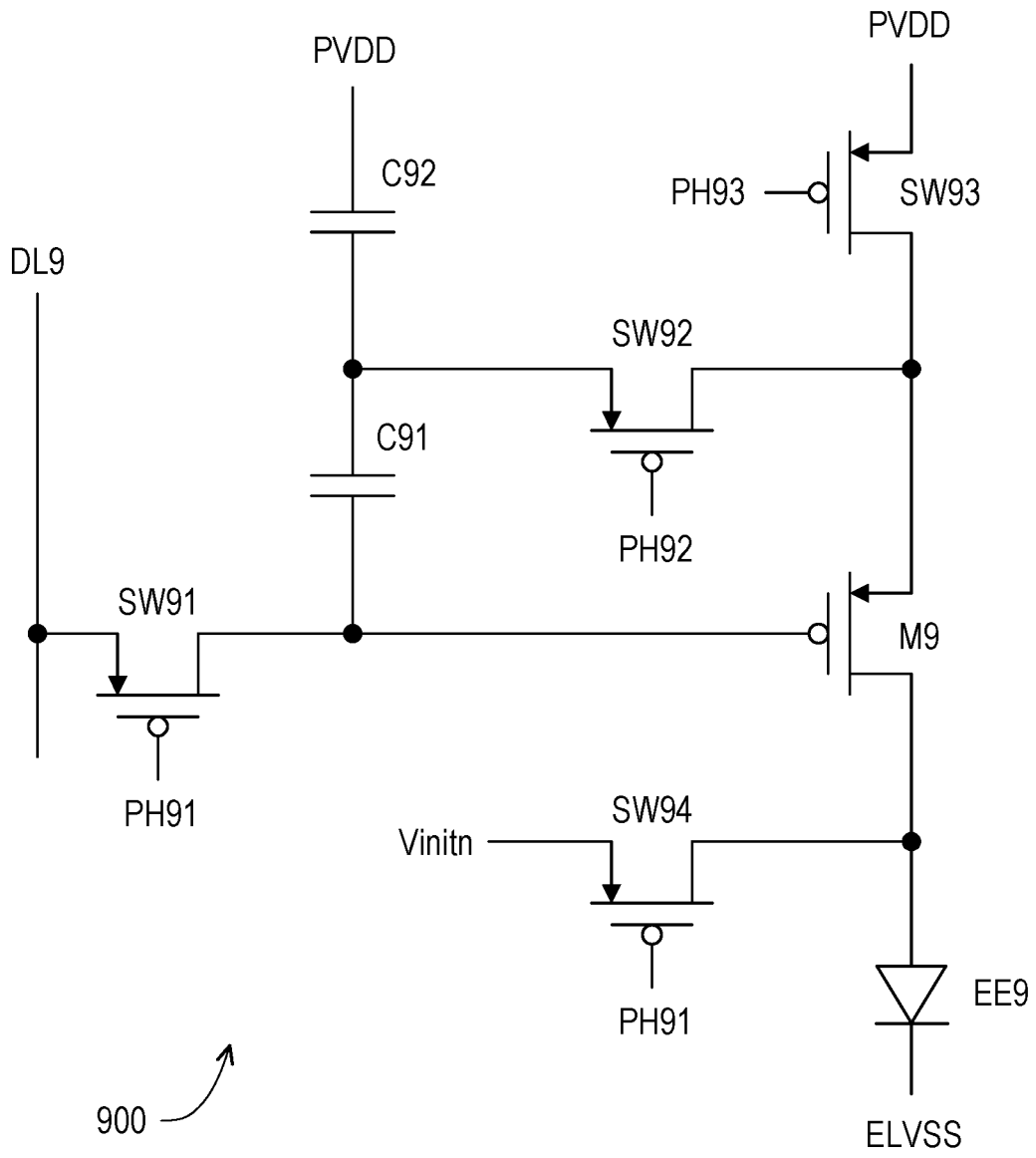
FIG. 9 is a circuit schematic diagram of a pixel circuit of a display panel according to a sixth embodiment of the disclosure.
Figure 10:
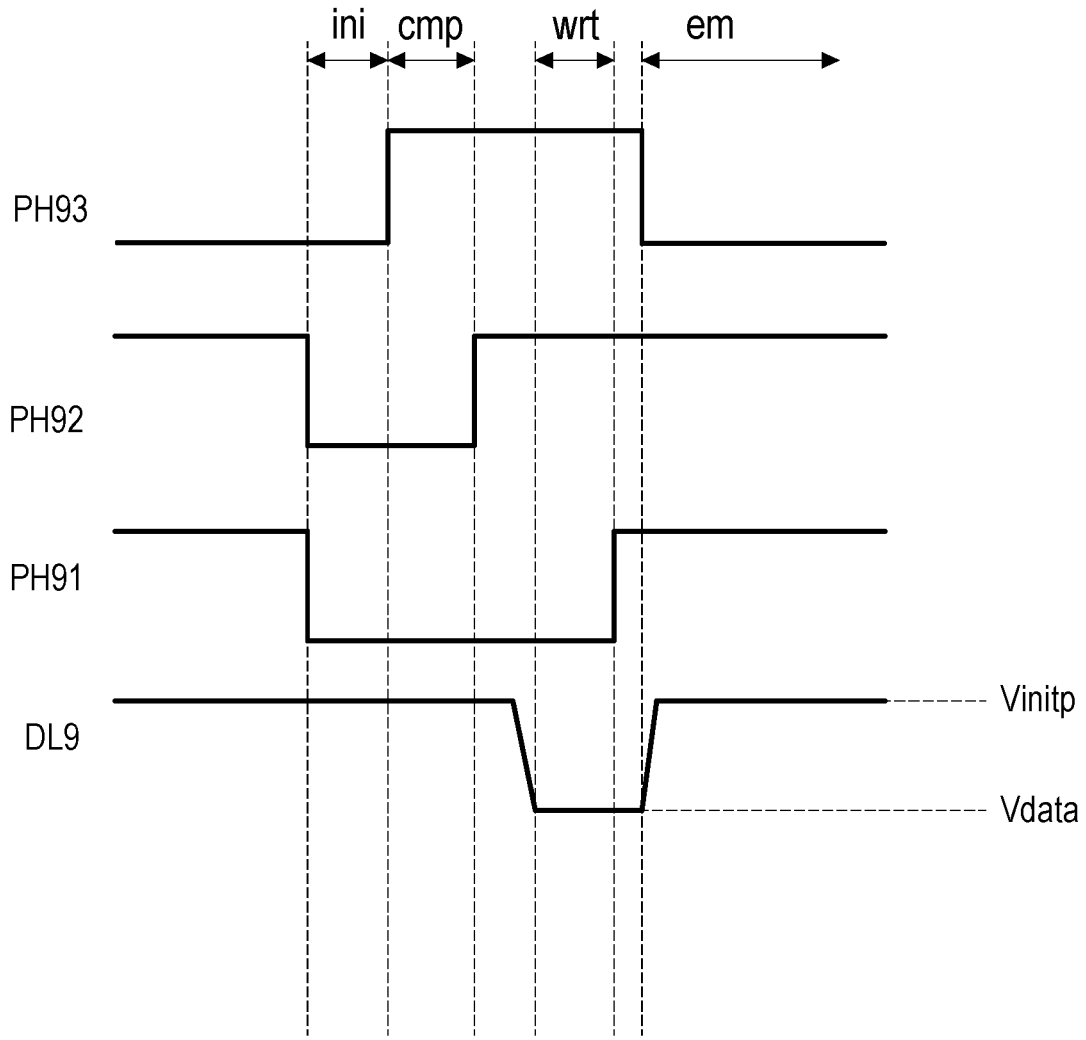
FIG. 10 is a time sequence schematic diagram of a control signal of a pixel circuit according to yet another embodiment of the disclosure.

FIG. 9 is a circuit schematic diagram of a pixel circuit 900 of a display panel according to a sixth embodiment of the disclosure. FIG. 10 is a time sequence schematic diagram of a control signal of a pixel circuit according to yet another embodiment of the disclosure. The pixel circuit 900 shown in FIG. 9 includes a light-emitting element EE9, a transistor M9, a capacitor C91, a capacitor C92, a switch SW91, a switch SW92, a switch SW93, and a switch SW94. The pixel circuit 900, the light-emitting element EE9, the transistor M9, the capacitor C91, the capacitor C92, the switch SW91, the switch SW92, the switch SW93, and the switch SW94 shown in FIG. 9 may refer by analogy to the pixel circuit 700, the light-emitting element EE7, the transistor M7, the capacitor C71, the capacitor C72, the switch SW71, the switch SW72, the switch SW73, and the switch SW74 shown in FIG. 7, and are not repeated herein. The control terminal (e.g., the gate) of the switch SW91 and the control terminal (e.g., the gate) of the switch SW94 is controlled by the control signal PH91. The control terminal (e.g., the gate) of the switch SW92 is controlled by the control signal PH92. The control terminal (e.g., the gate) of the switch SW93 is controlled by the control signal PH93.

In the embodiment shown in FIG. 9, the first terminal (e.g., the drain) of the switch SW93 is coupled to the second terminal (e.g., the drain) of the switch SW92 and the first terminal (e.g., the source) of the transistor M7, and the second terminal (e.g., the source) of the switch SW93 is coupled to the first power voltage line of the display panel to receive the power voltage PVDD. The second terminal of the transistor M9 is coupled to the first terminal (e.g., the anode) of the light-emitting element EE9, and the second terminal (e.g., the cathode) of the light-emitting element EE9 is coupled to the second power voltage line of the display panel to receive the power voltage ELVSS. The first terminal of the switch SW74 is coupled to the initialization voltage line of the display panel to receive the initialization voltage Vinitn. The second terminal of the switch SW74 is coupled to the second terminal of the transistor M9 and the first terminal of the light-emitting element EE9. In the pixel circuit 900 shown in FIG. 9, a driving current path of the pixel circuit 900 is formed between the first power voltage line transmitting the power voltage PVDD and the second power voltage line transmitting the power voltage ELVSS. The driving current of this driving current path flows from the first power voltage line through the switch SW93, the transistor M9, and the light-emitting element EE9 so that the light-emitting element EE9 emits light. The transistor M9 is disposed in this driving current path to adjust the driving current of the light-emitting element EE9.

During the compensation period cmp, the capacitor C91 may sample the threshold voltage Vt of the transistor M9 to compensate the pixel data. During the data writing period wrt, the first terminal of the capacitor C91 may store the data voltage from the data line DL7. During the emission period em, the switch SW92 is turned on, so that the capacitor C91 may maintain/clamp the voltage difference between the control terminal of the transistor M9 and the first terminal of the transistor M9 (e.g., the gate-source voltage Vgs) to the compensated voltage Vt+ΔV. Based on the stable gate-source voltage Vgs, the driving current flowing through the transistor M9 may be kept stable without being affected by the forward voltage variation of the light-emitting element EE9.

To sum up, the pixel circuits 100, 300, 400, 600, 700, and 900 of the aforementioned embodiments may use the capacitor to sample the threshold voltage Vt of the transistor to compensate the pixel data. The capacitor may maintain/clamp the gate source voltage Vgs of the transistor to the compensated voltage during the emission period. Based on the stable gate-source voltage Vgs, the driving current flowing through the transistor may be kept stable without being affected by the forward voltage variation of the light-emitting element.

Although the disclosure has been described in detail with reference to the above embodiments, they are not intended to limit the disclosure. Those skilled in the art should understand that it is possible to make changes and modifications without departing from the spirit and scope of the disclosure. Therefore, the protection scope of the disclosure shall be defined by the following claims.

What is claimed is:

1. A pixel circuit of a display panel, comprising:

a light-emitting element, wherein a driving current of a driving current path of the pixel circuit flows through the light-emitting element so that the light-emitting element emits light;

a transistor, disposed in the driving current path to adjust the driving current;

a first capacitor, having a first terminal coupled to a control terminal of the transistor, wherein the control terminal is a gate terminal of the transistor;

a second capacitor, having a first terminal coupled to a second terminal of the first capacitor, wherein a second terminal of the second capacitor is coupled to a reference voltage;

a first switch, having a first terminal coupled to a data line of the display panel, wherein a second terminal of the first switch is coupled to the first terminal of the first capacitor and the control terminal of the transistor; and a second switch, having a first terminal coupled to the second terminal of the first capacitor and the first terminal of the second capacitor, wherein a second terminal of the second switch is coupled to a first terminal of the transistor.

2. The pixel circuit according to claim 1, wherein the first capacitor samples a threshold voltage of the transistor during a compensation period, the first terminal of the first capacitor stores a data voltage from the data line during a data writing period, and the second switch is turned on during an emission period so that the first capacitor maintains a voltage difference between the control terminal of the transistor and the first terminal of the transistor to a compensated voltage.

3. The pixel circuit according to claim 1, wherein a second terminal of the transistor is coupled to a first power voltage line of the display panel, and the pixel circuit further comprises:

a third switch, having a first terminal coupled to the first terminal of the transistor and the second terminal of the second switch, wherein a second terminal of the third switch is coupled to a first terminal of the light-emitting element, and a second terminal of the light-emitting element is coupled to a second power voltage line of the display panel.

4. The pixel circuit according to claim 3, wherein the first switch, the second switch, the third switch, and the transistor are N-type metal oxide semiconductor transistors, the light-emitting element comprises a micro light-emitting diode or an organic light-emitting diode, the first terminal of the light-emitting element is an anode, and the second terminal of the light-emitting element is a cathode.

5. The pixel circuit according to claim 3, wherein, during an initialization period, the first switch and the second switch are turned on, the third switch is turned off, a first initialization voltage of the data line turns on the transistor through the first switch, and a second initialization voltage of the first power voltage line resets the second terminal of the first capacitor through the transistor and the second switch;

during a compensation period, the first switch and the second switch are turned on, the third switch is turned off, a voltage of the first power voltage line transitions from the second initialization voltage to a first power voltage thus turning off the transistor, so that the first capacitor samples a threshold voltage of the transistor;

during a data writing period, the first switch is turned on, the second switch and the third switch are turned off, the first capacitor maintains the threshold voltage of the transistor, the voltage of the data line transitions from the first initialization voltage to a data voltage, and the first terminal of the first capacitor stores the data voltage from the data line; and during an emission period, the first switch is turned off, the second switch and the third switch are turned on, the data voltage stored at the first tell final of the first capacitor drives the control terminal of the transistor, and the first capacitor maintains a voltage difference between the control terminal of the transistor and the first terminal of the transistor at a compensated voltage.

6. The pixel circuit according to claim 3, further comprising:

a fourth switch, having a first terminal coupled to an initialization voltage line of the display panel, wherein a second terminal of the fourth switch is coupled to the second terminal of the first capacitor and the first terminal of the second capacitor.

7. The pixel circuit according to claim 6, wherein, during an initialization period, the first switch and the fourth switch are turned on, the second switch and the third switch is turned off, a first initialization voltage of the data line resets the first terminal of the first capacitor and the control terminal of the transistor through the first switch, and a second initialization voltage of the initialization voltage line resets the second terminal of the first capacitor through the fourth switch;

during a compensation period, the first switch and the second switch are turned on, the third switch and the fourth switch are turned off, a voltage of the first terminal of the transistor transitions from the second initialization voltage to a direction of a first power voltage of the first power voltage line thus turning off the transistor, so that the first capacitor samples a threshold voltage of the transistor;

during a data writing period, the first switch is turned on, the second switch, the third switch, and the fourth switch are turned off, the first capacitor maintains the threshold voltage of the transistor, the voltage of the data line transitions from the first initialization voltage to a data voltage, and the first terminal of the first capacitor stores the data voltage from the data line; and during an emission period, the first switch and the fourth switch are turned off, the second switch and the third switch are turned on, the data voltage stored at the first terminal of the first capacitor drives the control terminal of the transistor, and the first capacitor maintains a voltage difference between the control terminal of the transistor and the first terminal of the transistor at a compensated voltage.

8. The pixel circuit according to claim 1, wherein a second terminal of the transistor is coupled to a first power voltage line of the display panel, and the pixel circuit further comprises:

a third switch, having a first terminal coupled to the first terminal of the second switch, the second terminal of the first capacitor, and the first terminal of the second capacitor, wherein a second terminal of the third switch is coupled to a first terminal of the light-emitting element, and a second terminal of the light-emitting element is coupled to a second power voltage line of the display panel.

9. The pixel circuit according to claim 1, further comprising:

a third switch, having a first terminal coupled to the first terminal of the transistor and the second terminal of the second switch, wherein a second terminal of the third switch is coupled to a first power voltage line of the display panel, a second terminal of the transistor is coupled to a first terminal of the light-emitting element, and a second terminal of the light-emitting element is coupled to a second power voltage line of the display panel; and a fourth switch, having a first terminal coupled to an initialization voltage line of the display panel, wherein a second terminal of the fourth switch is coupled to the second terminal of the transistor and the first terminal of the light-emitting element.

10. The pixel circuit according to claim 9, wherein the first switch, the second switch, the third switch, the fourth switch, and the transistor are P-type metal oxide semiconductor transistors, the light-emitting element comprises a micro light-emitting diode or an organic light-emitting diode, the first terminal of the light-emitting element is an anode, and the second terminal of the light-emitting element is a cathode.

11. The pixel circuit according to claim 9, wherein, during an initialization period, the first switch, the third switch, and the fourth switch are turned on, the second switch is turned off, a first initialization voltage of the data line turns off the transistor through the first switch, a second initialization voltage of the initialization voltage line initializes the first terminal of the light-emitting element through the fourth switch, and a first power voltage of the first power voltage line resets the second terminal of the first capacitor through the third switch;

during a compensation period, the first switch, the second switch, and the fourth switch are turned on, the third switch is turned off, a voltage of the first terminal of the transistor transitions thus turning off the transistor, so that the first capacitor samples a threshold voltage of the transistor;

during a data writing period, the first switch and the fourth switch are turned on, the second switch and the third switch are turned off, the first capacitor maintains the threshold voltage of the transistor, the voltage of the data line transitions from the first initialization voltage to a data voltage, and the first terminal of the first capacitor stores the data voltage from the data line; and during an emission period, the first switch and the fourth switch are turned off, the second switch and the third switch are turned on, the data voltage stored at the first terminal of the first capacitor drives the control terminal of the transistor, and the first capacitor maintains a voltage difference between the control terminal of the transistor and the first terminal of the transistor at a compensated voltage.

12. The pixel circuit according to claim 1, further comprising:

a third switch, having a first terminal coupled to the first terminal of the second switch, the second terminal of the first capacitor, and the first terminal of the second capacitor, wherein a second terminal of the third switch is coupled to a first power voltage line of the display panel, a second terminal of the transistor is coupled to a first terminal of the light-emitting element, and a second terminal of the light-emitting element is coupled to a second power voltage line of the display panel; and a fourth switch, having a first terminal coupled to an initialization voltage line of the display panel, wherein a second terminal of the fourth switch is coupled to the second terminal of the transistor and the first terminal of the light-emitting element.

* * * * *